United States Patent [19]

Chase

[11] 4,183,520

[45] Jan. 15, 1980

[54] EXERCISING DEVICE HAVING OPERABLY INTERCONNECTED PRIMARY AND SECONDARY PIVOT ARMS

[76] Inventor: Daniel F. Chase, 705 Willow, Apt. 3, Kelso, Wash. 98626

[21] Appl. No.: 884,918

[22] Filed: Mar. 9, 1978

[51] Int. Cl.[2] ..... A63B 21/00

[52] U.S. Cl. ..... 272/130; 272/134; 272/143; 272/DIG. 4

[58] Field of Search ..... 272/134, 130, 136, 142, 272/143, DIG. 4, DIG. 1, 117, 118

[56] References Cited

U.S. PATENT DOCUMENTS

| | | | |
|---|---|---|---|
| 2,825,563 | 3/1958 | Lawton | 272/130 |
| 3,558,131 | 1/1971 | Dragon | 272/142 X |
| 3,850,430 | 11/1974 | Hamilton | 272/117 |
| 3,902,717 | 9/1975 | Kulkens | 272/142 X |
| 3,976,058 | 8/1976 | Tidwell | 272/134 X |

*Primary Examiner*—Richard C. Pinkham
*Assistant Examiner*—William R. Browne
*Attorney, Agent, or Firm*—Chernoff & Vilhauer

[57] ABSTRACT

A physical exercise device is comprised of an L-shaped main pivot arm which is pivotally connected intermediate its ends to one end of a support frame, and has pivotally attached to the distal extremity of its horizontal leg a secondary pivot arm. A lever arm, which is pivotally connected to the opposite end of the frame, is interconnected intermediate its ends by a piston cylinder counterbalancing unit to the frame below the main pivot arm, and a cable interconnects the free extremity of the lever arm and the free end of the secondary pivot arm. The cable medially passes over a first set of pulleys located near the lower end of the vertical leg of the main pivot arm, and a second set of pulleys located on the support frame adjacent to the first set, so that when the main pivot arm is rotated with respect to the frame, or when the secondary pivot arm is rotated with respect to the main pivot arm, the cable is pulled therealong, thereby causing the lever arm to be rotated downwardly against the resistance of the counterbalancing unit. The counterbalancing unit is slidably mounted on the lever arm and an adjustment system allows its relative position to be changed. As a result, the exercising force can be adjusted to suit the user.

13 Claims, 8 Drawing Figures

FIG. 1
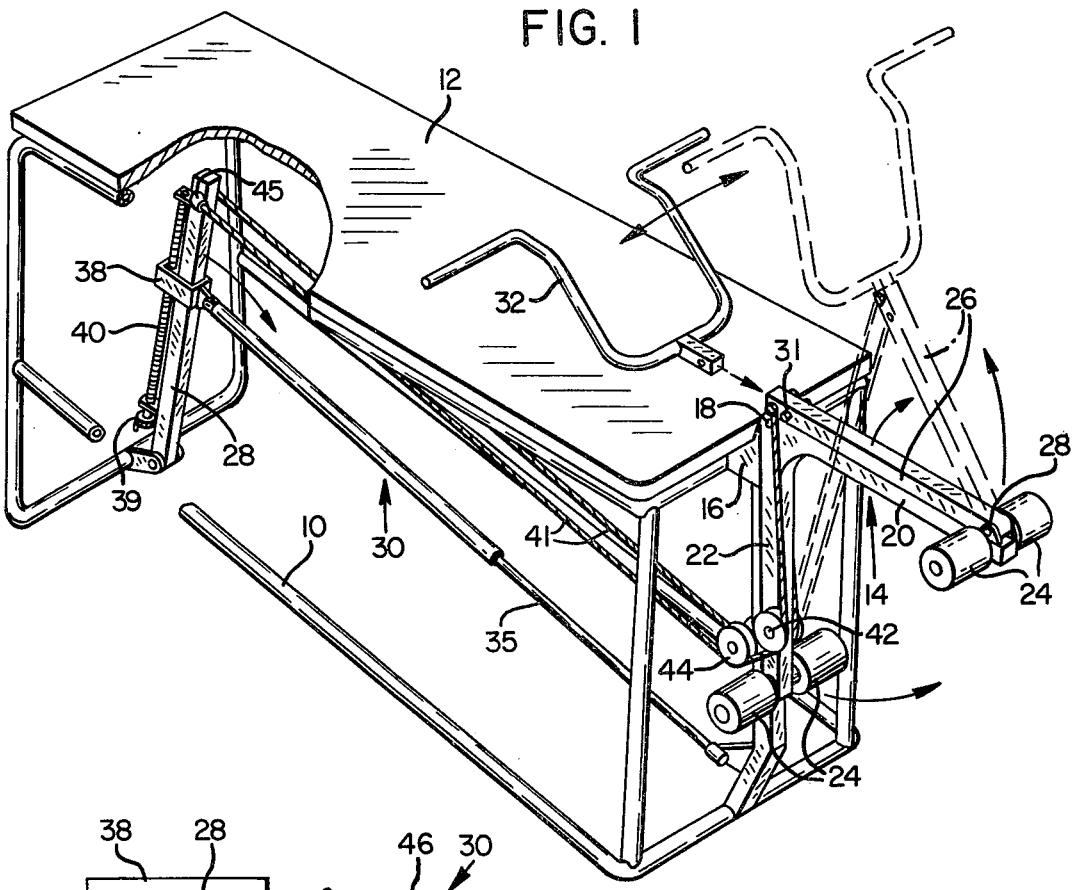
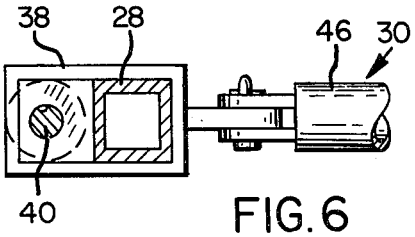
FIG. 6
FIG. 2
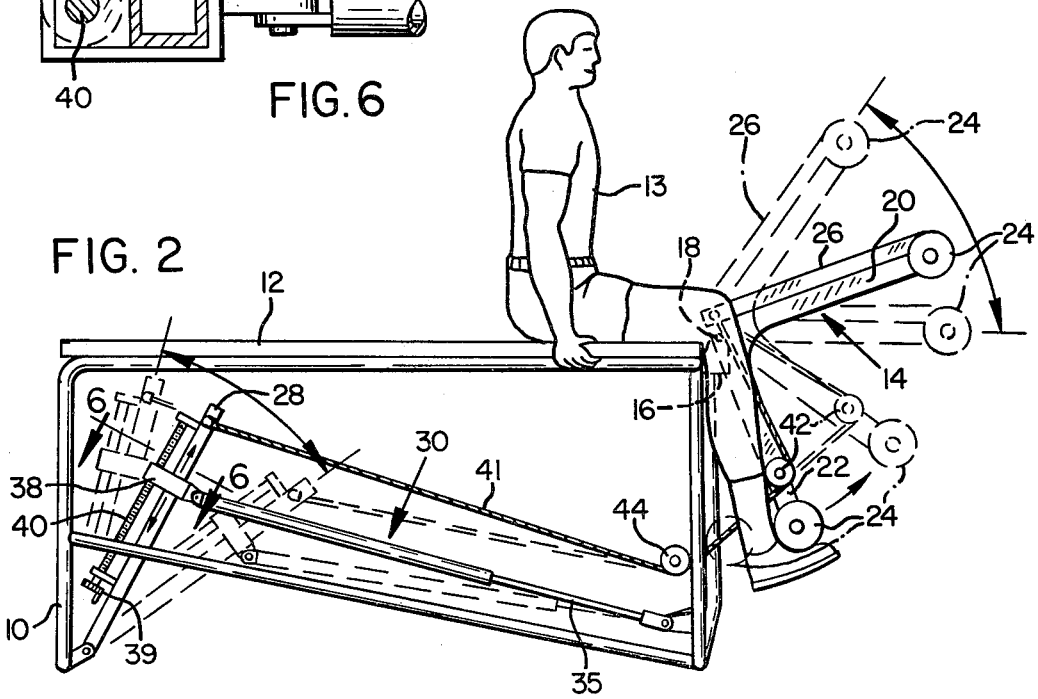

FIG. 3
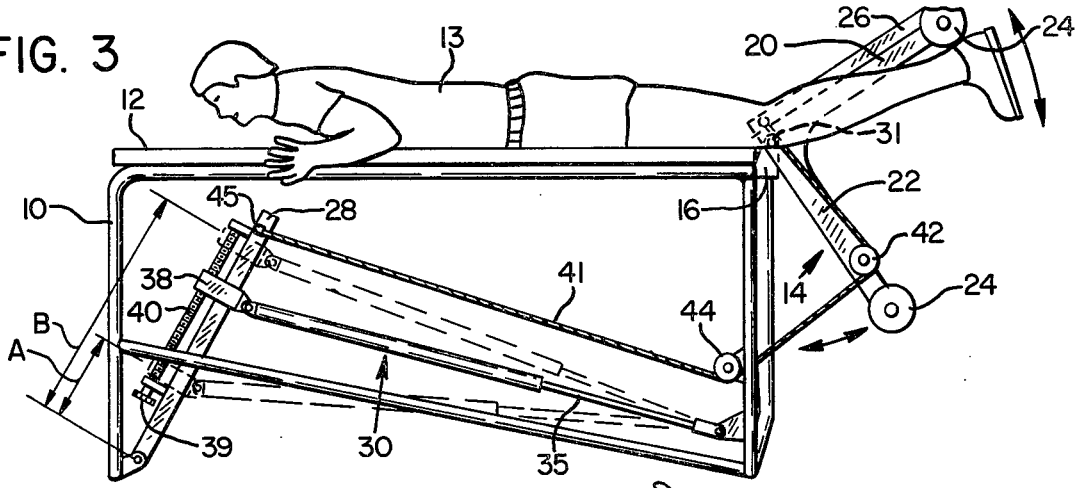
FIG.7
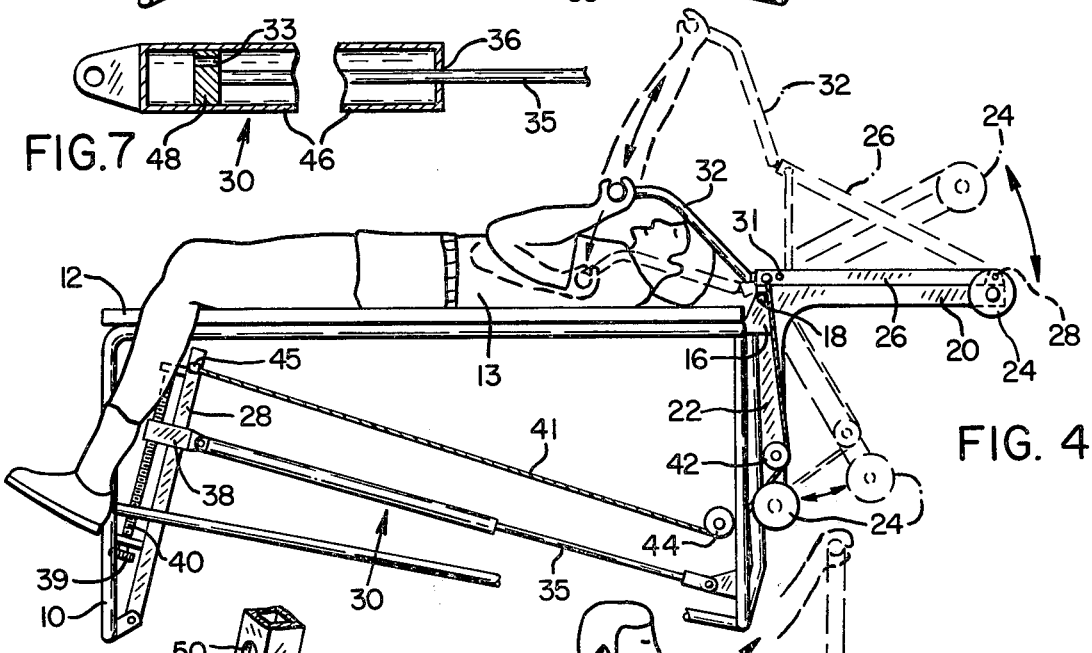
FIG. 4
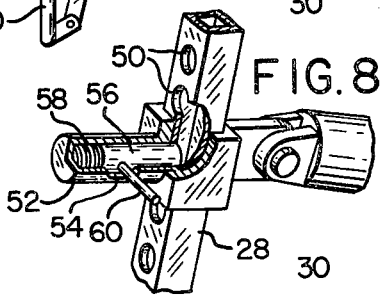
FIG. 8
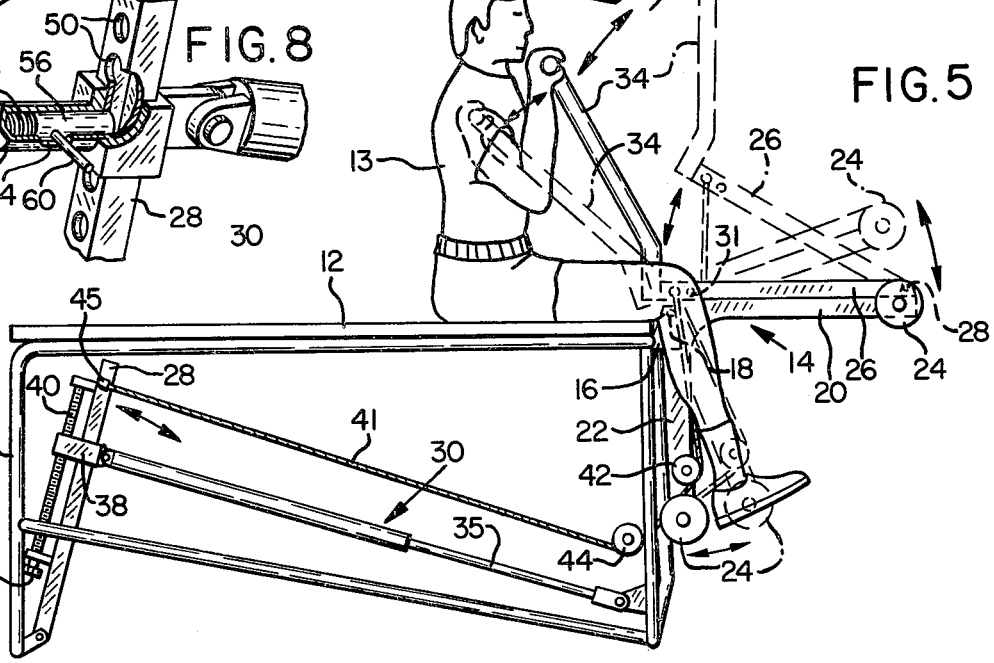
FIG.5

EXERCISING DEVICE HAVING OPERABLY INTERCONNECTED PRIMARY AND SECONDARY PIVOT ARMS

BACKGROUND OF THE INVENTION

This invention relates to an exercise device of the type having variable force adjustment.

Physical exercise devices upon which a person can perform a broad range of exercises for his limbs are known in the prior art. However, the prior art devices of this class have shortcomings which limit their usefulness as an all purpose exerciser.

While there are prior art exercisers which provide a constant exercising force over their entire range of travel, those that do are adapted for a single purpose rather than covering a wide range of exercises, as is typlified by Muir, U.S. Pat. No. 3,912,265. However, it is desirable that a constant exercising force also be provided in multipurpose exercisers of the class of the subject invention.

Also, it is desirable that the amount of exercising force can be easily adjustable so that the device can be used by persons of differing capabilities, or by one person for exercises requiring different levels of exercising force. While prior art exercisers do have this feature, they are either complex, and thus expensive to fabricate, such as Brenthan, U.S. Pat. No. 3,822,599, or else they are large and unwieldy such as Kulkens, U.S. Pat. No. 3,638,941.

SUMMARY OF THE INVENTION

Accordingly, it is the principal object of the present invention to devise a multi-purpose exercise device which is compact, is easy to adjust for setting the level of exercising force and provides a constant level of exercising force over its entire range of travel.

It is a further object of the present invention to provide such an exercise device which is of simple design for inexpensive manufacture and ease of operation.

To provide such an exerciser, an L-shaped main pivot arm is pivotally attached at its center to the upper edge of one end of a support frame having a horizontal bed for supporting the user. Located on top of the horizontal leg of the main pivot arm, is a secondary pivot which is pivotally joined to the outer end of the horizontal leg for rotation upwardly therefrom. A cable, which is attached to the free end of the secondary pivot arm, extends downardly over pulleys located at the extremity of the vertical leg of the main pivot arm and on the frame adjacent thereto, then passes under the frame to joinder with the upper end of a lever arm, which is pivotally attached at its lower end to the lower edge of the end of the frame opposite to the main pivot arm. Accordingly, rotation of the main pivot arm with respect to the frame, or rotation of the secondary pivot arm with respect to the main pivot arm causes the lever arm to be rotated also.

However, the lever arm is restrained against rotation by means of a piston cylinder counter-balancing unit which interconnects the lever arm, intermediate its ends, with the frame, at a point below the main pivot arm. The counter-balancing unit is slidably attached to the lever arm by a harness and can be fixed to it by either of two adjustment systems. In the first, a threaded rod, which is rotatably mounted on the lever arm, passes through a threaded bore located in the harness, so that by rotating the threaded rod the relative position of the counter-balancing unit along the lever arm can be changed. In the second, a spring loaded pin carried by the harness releasably is engaged into openings located in the lever arm in order to secure the harness to the lever arm at the desired location. In either embodiment the adjustment system serves to vary the amount of exercising force generated by the device.

Arm attachments releasably fit into the free end of the secondary pivot arm to provide means whereby the user can perform arm exercises on the device, and rolls are attached at the extremities of both the horizontal and vertical legs of the main pivot arm for performing leg exercises.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view, partially broken away and partially exploded, showing a preferred embodiment of the exercising device of the present invention.

FIGS. 2, 3, 4 and 5 are side elevational views showing various manners in which the device is used.

FIG. 6 is a fragmentary sectional view taken along the line 6—6 in FIG. 2.

FIG. 7 is a foreshortened sectional view showing the counter-balancing unit which is used on the exercising device.

FIG. 8 is a fragmentary pictorial view, partially broken away, showing an alternate embodiment of the force adjustment system.

DETAILED DESCRIPTION OF THE INVENTION

Referring to FIG. 1 of the drawings, the exercise device of the present invention includes a tubular frame 10 which supports the remaining elements of the device. Mounted horizontally on top of the frame, which preferably lies approximately three feet off of the ground, is a planar rectangular bed 12 which is designed to support a user 13 in either a sitting position, FIGS. 2 and 5, or a prone position, FIGS. 3 and 4.

Mounted at one end of the frame, adjacent to the bed, is an L-shaped main pivot arm 14. The main pivot arm is freely pivotally mounted in a bifurcated bracket 16 by means of a pin 18 in a manner such that a first leg 20 of the arm normally lies substantially horizontal and a second leg 22 normally lies substantially vertical. Rotatably mounted at the extremity of each leg on each side thereof are tubular rolls 24.

Lying on top of the first leg is a secondary pivot arm 26 which is the same length as the first leg and which is joined to its extremity by means of a pin 28. Thus the secondary pivot arm is rotatable between a raised position above the first leg 20, as shown in phantom line in FIG. 1, and a lower position on top of the secondary pivot arm, as shown in solid line in FIG. 1. The unhinged extremity of secondary pivot arm 26 is hollow to receive attachments which increase the range and versatility of the device, and ball detent 31 releasably secures the attachments in place when they are inserted therein.

Prone attachment 32, FIGS. 1 and 4, includes a U-shaped body with outwardly extending arms at each end, and it angles upwardly over the bed at a shallow angle so that the arms are located immediately above a user lying on the bed when the secondary pivot arm is in its lowered position. A sitting attachment 34, FIG. 5, is shaped similarly to the prone attachment except that it is angled upwardly at close to 90° so that its arms are located near the chin of the user when he is sitting on the bed with his feet hanging over its edge, with the secondary pivot arm in its lowered position.

An elongate lever arm 28, pivotally attached to the bottom of the frame at the end opposite the main pivot arm, serves as the force generating means of the exercise device. The lever arm is connected intermediate its ends to the frame by a linear compression device, such as piston cylinder counter-balancing unit 30.

Referring now to FIG. 7, the counter-balancing unit is of the commercially available type and comprises an elongate, tubular cylinder 46 with a cylindrical piston 48, having a small bore 33 passing through it, slidably communicating within. A ram 35, which is connected to the piston, extends out of the cylinder through an opening 36 located in one of its ends. The piston forms a seal with the cylinder and the ram forms a seal with the opening so that when pressurized air is introduced into the cylinder, the pressure equalizes on both sides of the piston through bore 33 even when the piston is translated in the cylinder. However, since the area of one side of the piston is less than the area of the other side, due to the attachment of ram 35, the force generated on the piston by the pressurized air is greater on the side without the ram. Therefore, the piston and ram are continually urged toward one end of the cylinder by a force which remains relatively constant irrespective of the placement of the piston in the cylinder.

Accordingly, when the counter-balancing unit is installed in the device as shown, with ram 35 pivotally connected to the frame below the main pivot arm, and the cylinder connected to the lever arm, it exerts a constant force on the lever in a manner to cause it to pivot counter-clockwise, as shown in the drawings. However, in the embodiment illustrated, the location at which the cylinder is connected to the lever arm is adjustable, since the cylinder is joined to the lever by means of a harness 38, FIG. 6, which slidingly engages the lever and an adjustment system allows selective positioning of the harness on the lever arm.

In a first embodiment of the adjustment system, rotatably joined to the aback side of the lever and extending over nearly its entire extent, is a threaded rod 40 which passes through a threaded bore located in harness 38. Therefore, rotation of the threaded rod, which is facilitated by a knob 39 located at its lower end, causes the harness and thus the counter-balancing unit, to be translated along lever 28 as shown in FIG. 3.

In a second embodiment of the adjustment system, shown in FIG. 8, openings 50 are located at spaced intervals along one side of lever arm 28. A similar opening passes through the harness on the side which is adjacent to openings 50, and a hollow cylindrical guide 52, having opposed slots 54 located in its sides, is attached to the harness coaxially with the opening in it. Slidably fitting within guide 52 is an elongate pin 56 which has a diameter to loosely fit through the opening in the harness and an aligned opening 50. A spring 58 located in the guide, behind pin 51, urges the pin toward opening 50, and a keeper 60, which fits tightly through a bore located in the pin and through slots 54, restricts the travel of pin 56. Accordingly, the pin normally fits into the opening 50, but can be urged out of it by displacement of keeper 60 to enable sliding the harness to another position along lever arm 28.

The lever is connected to the secondary pivot arm 26 by a cable 41 which has one end attached to each side of the free end of the secondary pivot arm. The cable extends downwardly along both sides of second leg 22 and around a set of first pulleys 42, which are located near its lower extremity. The cable then extends around a set of second pulleys 44, which are located on frame 10 downwardly adjacent to pulleys 42, and the center portion of the cable extends freely through a cable guide 45 which is located at the top of lever arm 28.

In the primary mode of operation, main pivot arm 26 is pivoted counter-clockwise, as shown in the drawings, by engaging the users limbs under rolls 24. This can be accomplished in several manners, two of which are illustrated in FIGS. 2 and 5 of the drawings. As the main pivot arm is pivoted, first pulley 42 is moved upwardly and outwardly thereby pulling cable 41 and causing lever arm 26 to be rotated clockwise. However, the rotation of lever arm 26 is resisted by counter-balancing unit 30, thereby causing the main pivot arm to impart a resisting force to the users limbs.

In the secondary mode of operation, illustrated in FIGS. 3 and 4, one of the attachments 32 and 34 is inserted into secondary pivot arm 26 for performing arm exercises. In this mode the secondary pivot arm is pivoted, by the user's arms, upwardly with respect to the main pivot arm, thereby again pulling cable 41 around pulleys 42 and 44. The reaction of lever arm 28 and counter-balancing unit 30 is the same as in the primary mode in providing a resistance force.

In either mode of operation if a greater or lesser amount of resistive force is desired, harness 38 is moved up or down respectively on the lever arm either by turning rod 40, or by releasing pin 56 and manually moving the harness, thereby respectively increasing or decreasing the moment arm through which the resistive force of the counter-balancing unit is transmitted to the pivot arms. As seen in FIG. 3, the minimum exercising force is provided when harness 38 is located at the bottom of the lever arm, distance A from the lower extremity of the lever arm, and the maximum exercising force is provided when harness 38 is located at the top of the lever arm, distance B from the lower extremity of the lever arm.

Accordingly, the amount of exercising force generated on the user's limbs through the pivot arms is adjustable, and it remains constant over the complete movement of either the main or secondary pivot arm irrespective of its absolute level.

The terms and expressions which have been employed in the foregoing abstract and specification are used therein as terms of description and not of limitation, and there is no intentions, in the user of such terms and expressions, of excluding equivalents of the features shown and described or portions thereof, it being recognized that the scope of the invention is defined and limited only by the claims which follow.

What is claimed is:

1. A physical exercise device comprising:

(a) a supportive frame;

(b) a counter-balancing unit including a linear compression device;

(c) an elevated bed, located above said supportive frame for supporting a user;

(d) a main pivot arm pivotally connected to said bed at one end thereof;

(e) a lever arm pivotally connected at one end to said frame a spaced distance below said bed, on the end thereof opposite said main pivot arm;

(f) cable means interconnecting said main pivot arm and the other end of said lever arm in a manner such that rotation of said main pivot arm causes rotation of said lever arm; and (g) a linear compression device interconnecting said lever arm and said main frame in a manner to counteract said rotation of said lever arm, said linear compression device comprising a pressurized sealed tubular cylinder being directly connected to the lever arm at one end thereof having a piston slidably communicating therein, said piston having a valve opening which passes therethrough, and having a ram attached to one end to one side of said piston and said ram extending out of said cylinder and being directly connected to the frame at the opposite end thereof, so that said linear compression device resists a force applied by a user on said lever arm irrespective of the position of said piston in said tubular cylinder and irrespective of whether any activating force is being applied to said main pivot arm.

2. The exercise device of claim 1 including adjustment means associated with said lever arm for selectively positioning said counter-balancing unit thereon.

3. The exercise device of claim 2 wherein the adjustment means comprises:

(a) a threaded rod, located parallel with and rotatably joined to said lever arm;

(b) a harness defining a passageway therethrough arranged for slidably receiving said lever arm;

(c) said harness having a threaded bore located therein along side said passageway, adapted for engaging said threaded rod, to allow selectively positioning said harness on said lever arm upon rotation of said threaded rod.

4. The exercise device of claim 2 wherein the adjustment means comprises:

(a) said lever arm defining a series of spaced apart openings in one side thereof;

(b) a harness defining a passageway therethrough arranged for slidably receiving said lever arm;

(c) a spring biased pin, and a guide slidably carrying said pin and attached to said hrness in a manner such that said pin is urged into one of said openings when in alignment therewith; and (d) keeper means associated with said pin for limiting the travel of said pin between an extended position wherein it is engaged within one of said openings and a retracted position wherein it is disengaged from said opening.

5. The exercise device of claim 1 wherein said main pivot arm includes a first leg which is normally disposed generally parallel with respect to said bed, and a second leg which is generally perpendicular to said first leg, first pulley means which is located on said second leg near the distal extremity thereof, second pulley means which is located on said frame adjacent to said first pulley, cable attach means which are located on said first leg proximate its intersection with said second leg, and said cable means extending from aid lever arm around said first and second pulley means to join with said cable attach means.

6. The exercise device of claim 5 including rolls rotatably attached to the extremities of both legs of said main pivot arm on each side thereof.

7. The exercise device of claim 5 wherein said first and second pulley means each comprise two pulleys and the cable is reversely bent and attached medially to the lever arm with both ends joined to said cable attach means.

8. The exercise device of claim 5 including a secondary pivot arm pivotally attached at one end to the distal extremity of said first leg, wherein said cable attach means is located in the other end of said secondary pivot arm.

9. The exercise device of claim 8 including a prone attachment and means for releasably attaching said prone attachment to said secondary pivot arm so that said prone attachment projects outwardly from said other end thereof over said bed and sloping upwardly therefrom at a shallow angle.

10. The exercise device of claim 8 including a sitting attachment and means for releasably attaching said sitting attachment to said secondary pivot arm so that it projects outwardly from said other end thereof over said bed sloping upwardly therefrom at nearly 90°.

11. A physical exercise device comprising:

(a) a supportive frame;

(b) an elevated bed, located above said supportive frame for supporting a user;

(c) a main pivot arm pivotally connected to said bed at one end thereof, said main pivot arm including a first leg which is normally disposed generally parallel with respect to said bed, and a second leg which is generally perpendicular to said first leg;

(d) a secondary pivot arm pivotally attached at one end to the distal extremity of said first leg;

(e) first pulley means located on said second leg near the distal extremity thereof, second pulley means located on said frame adjacent to said first pulley means; and (f) cable means attached at one end thereof to said secondary pivot arm, at the end thereof opposite the end attached to said first leg, extending around said first and second pulley means and attached at the other end thereof to the extremity of a lever arm.

12. The exercise device of claim 11 including a prone attachment and means for releasably attaching said prone attachment to said secondary pivot arm so that said prone attachment projects outwardly from said other end thereof over said bed and sloping upwardly therefrom at a shallow angle.

13. The exercise device of claim 11 including a sitting attachment and means for releasably attaching said sitting attachment to said secondary pivot arm so that it projects outwardly from said other end thereof over said bed sloping upwardly therefrom at nearly 90°.

* * * * *

UNITED STATES PATENT AND TRADEMARK OFFICE

CERTIFICATE OF CORRECTION

PATENT NO. : 4,183,520

DATED : January 15, 1980

INVENTOR(S) : CHASE, Daniel F.

It is certified that error appears in the above-identified patent and that said Letters Patent are hereby corrected as shown below:

| | |
|---|---|
| Col. 4, line 55 | Change "user" to --use--; |
| Col. 5, line 46 | Change "hrness" to --harness--. |
| Col 6, line 2 | Change "aid" to --said--. |

Signed and Sealed this

*Twenty-third* Day of *December 1980*

[SEAL]

*Attest:*

SIDNEY A. DIAMOND

*Attesting Officer*

*Commissioner of Patents and Trademarks*